US011569572B2

(12) United States Patent
Kulkarni et al.

(10) Patent No.: US 11,569,572 B2
(45) Date of Patent: Jan. 31, 2023

(54) WATCH WITH INTEGRATED ANTENNA CONFIGURATION

(71) Applicant: Garmin Switzerland GmbH, Schaffhausen (CH)

(72) Inventors: Anup N. Kulkarni, Olathe, KS (US); Jeremiah H. Estes, Olathe, KS (US); Jason D. George, Overland Park, KS (US)

(73) Assignee: Garmin Switzerland GmbH

( * ) Notice: Subject to any disclaimer, the term of this patent is extended or adjusted under 35 U.S.C. 154(b) by 74 days.

(21) Appl. No.: 17/235,618

(22) Filed: Apr. 20, 2021

(65) Prior Publication Data

US 2022/0131263 A1 Apr. 28, 2022

Related U.S. Application Data

(60) Provisional application No. 63/106,464, filed on Oct. 28, 2020.

(51) Int. Cl.

| | |
|---|---|
| ***H01Q 1/24*** | (2006.01) |
| ***H01Q 1/52*** | (2006.01) |
| ***H01Q 9/04*** | (2006.01) |
| ***H01Q 1/27*** | (2006.01) |

(52) U.S. Cl.

CPC ..... *H01Q 1/521* (2013.01); *H01Q 1/241* (2013.01); *H01Q 1/273* (2013.01); *H01Q 9/0421* (2013.01)

(58) Field of Classification Search

CPC ..... H01Q 1/521; H01Q 1/241; H01Q 1/273; H01Q 9/0421

See application file for complete search history.

(56) References Cited

U.S. PATENT DOCUMENTS

| | | | |
|---|---|---|---|
| 9,172,148 | B2 | 10/2015 | Lyons et al. |
| 9,257,740 | B2 | 2/2016 | Lyons et al. |
| 10,271,299 | B1 | 4/2019 | Sayem et al. |
| 10,276,925 | B2 | 4/2019 | Han et al. |

(Continued)

FOREIGN PATENT DOCUMENTS

| | | | |
|---|---|---|---|
| JP | 2009168656 A | * | 7/2009 |
| WO | 2018183678 A1 | | 10/2018 |

OTHER PUBLICATIONS

U.S. Appl. No. 16/781,691, filed Feb. 4, 2020.
U.S. Appl. No. 17/194,557, filed Mar. 8, 2021.

*Primary Examiner* — Dieu Hien T Duong
(74) *Attorney, Agent, or Firm* — Samuel M. Korte; Max M. Ali

(57) ABSTRACT

A wrist-worn electronic device comprises a housing, a display, a bezel, and a location determining antenna. The housing includes an internal cavity, a bottom wall configured to contact a wearer's wrist, and a side wall defining a portion of the internal cavity and including an upper surface. The display is aligned with the internal cavity and configured to display information. The bezel surrounds the display and is coupled to the housing. The bezel includes a lower surface incorporating a channel positioned around the upper surface of the side wall. The location determining antenna is configured to receive global navigation satellite system wireless signals and is positioned within the channel of the bezel above the upper surface of the side wall. The location determining antenna includes a planar portion oriented in parallel with a plane of the bezel.

18 Claims, 7 Drawing Sheets

(56) References Cited

U.S. PATENT DOCUMENTS

| | | | | |
|---|---|---|---|---|
| 10,581,145 | B2 | 3/2020 | Han et al. | |
| 10,944,158 | B2 | 3/2021 | Sayem et al. | |
| 10,971,805 | B2 | 4/2021 | Kenkel et al. | |
| 2012/0170423 | A1* | 7/2012 | Fujisawa ..... | G04R 60/12 368/10 |
| 2019/0131696 | A1 | 5/2019 | Hanshew et al. | |

* cited by examiner

WATCH WITH INTEGRATED ANTENNA CONFIGURATION

RELATED APPLICATIONS

The current patent application is a regular utility patent application which claims priority benefit, with regard to all common subject matter, to U.S. Provisional Application Ser. No. 63/106,464, filed Oct. 28, 2020, and entitled "WATCH WITH INTEGRATED ANTENNA CONFIGURATION". The provisional application is incorporated by reference in its entirety into the current patent application.

BACKGROUND

Wrist-worn electronic devices often include functionality that may be used to track wearers' current locations, distances traveled, velocities, and other performance metrics or data. This functionality may be provided by receiving positional information from a satellite-based positioning system such as the global navigation satellite system (GNSS). In addition, such devices may communicate wirelessly with other electronic devices, systems, or networks to monitor a user's activities, running or biking performance, upload and download data, receive messages and information, and so forth. The communication protocols utilized to transmit and receive information may include Bluetooth, Wi-Fi, or telecommunication, such as cellular, signaling protocols. The electronic device may include two or more antennas that are utilized to receive signals from GNSS satellites and wirelessly communicate with other electronic devices or telecommunication services. In certain configurations, undesired coupling may be present between the two or more antennas when each is simultaneously utilized to wirelessly transmit and/or receive signals, such as location signals and communication signals, having similar frequencies.

SUMMARY

Embodiments of the present technology provide a wrist-worn electronic device with a dual antenna configuration that receives signals from GNSS satellites and wirelessly communicates with other electronic devices or telecommunication services. An embodiment of the electronic device broadly comprises a housing, a display, a bezel, a location determining antenna, and a communication antenna. The housing includes an internal cavity, a bottom wall configured to contact a wearer's wrist, and a side wall defining a portion of the internal cavity and including an upper surface. The display is aligned with the internal cavity and configured to display information. The bezel surrounds the display and is coupled to the housing. The bezel includes a lower surface incorporating a channel positioned around the upper surface of the side wall. The location determining antenna is configured to receive global navigation satellite system wireless signals. The location determining antenna is positioned within the channel of the bezel above the upper surface of the side wall and includes a planar portion oriented in parallel with a plane of the bezel. The communication antenna is configured to transmit and receive communication protocol wireless signals. The communication antenna is positioned within the channel of the bezel above the upper surface of the side wall and includes a planar portion oriented in parallel with a plane of the bezel.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present technology will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 5:
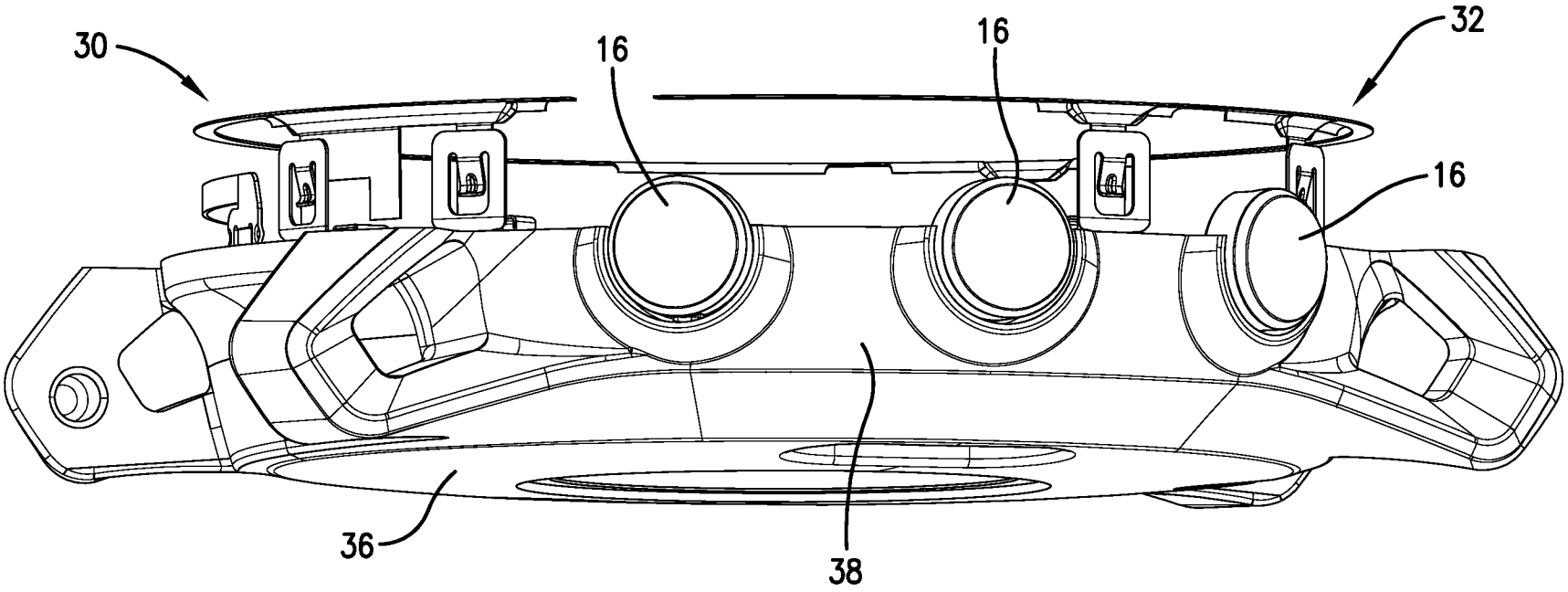
Figure 6:
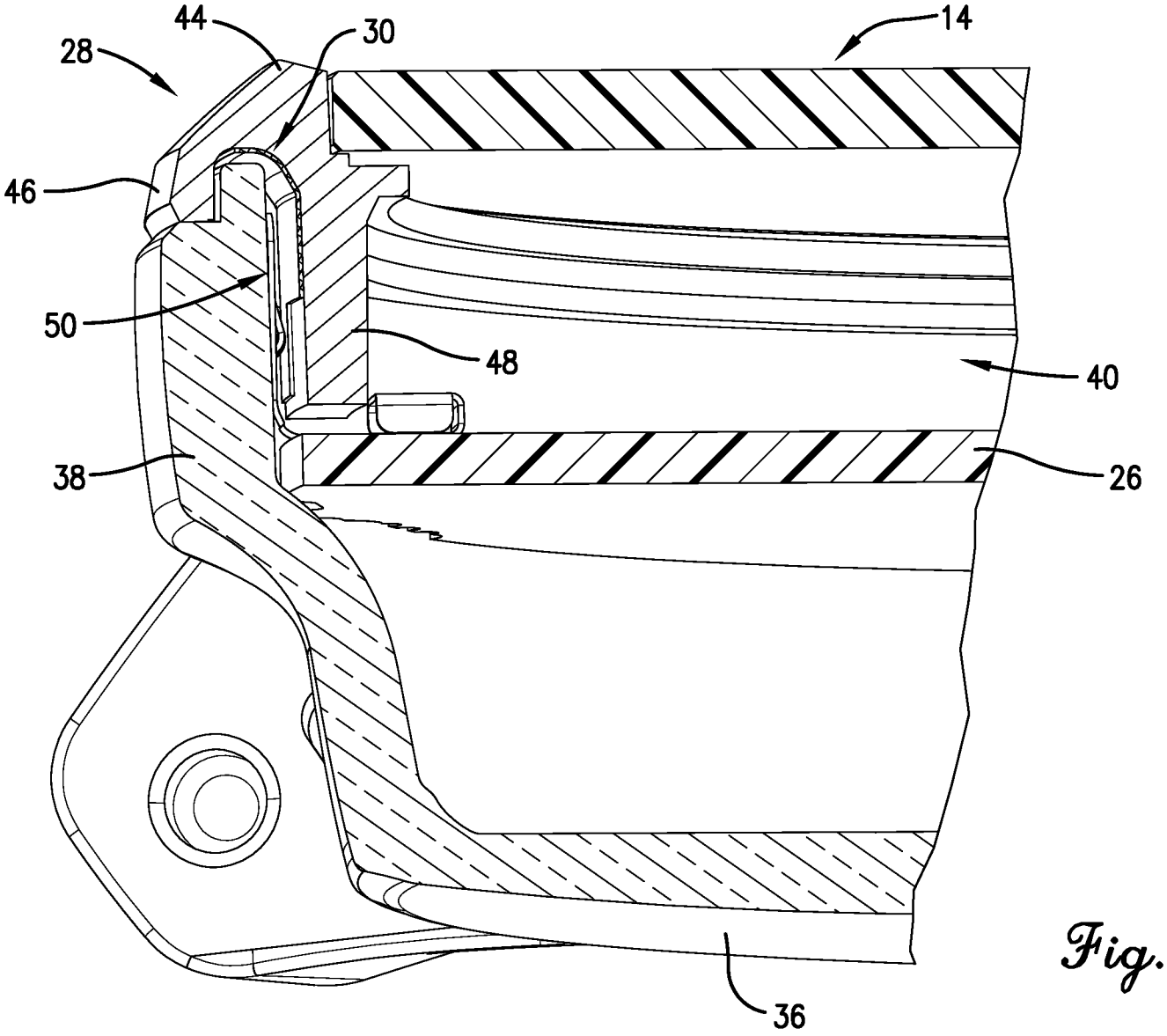

FIG. 5 is a lower perspective view of the electronic device with the display, the bezel, and the portion of the housing removed to reveal the location determining antenna and the communication antenna; and FIG. 6 is a fragmentary sectional view of the electronic device cut along a vertical plane to illustrate a channel in which the location determining antenna and the communication antenna are placed.

The drawing figures do not limit the present technology to the specific embodiments disclosed and described herein. While the drawings do not necessarily provide exact dimensions or tolerances for the illustrated components or structures, the drawings are to scale as examples of certain embodiments with respect to the relationships between the components of the structures illustrated in the drawings.

DETAILED DESCRIPTION

The following detailed description of the technology references the accompanying drawings that illustrate specific embodiments in which the technology can be practiced. The embodiments are intended to describe aspects of the technology in sufficient detail to enable those skilled in the art to practice the technology. Other embodiments can be utilized and changes can be made without departing from the scope of the present technology. The following detailed description is, therefore, not to be taken in a limiting sense. The scope of the present technology is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Relational terms, such as "above", "below", "over", "beneath", "upper", "upward", "lower", "downward", "top", "bottom", "outer", "inner", etc., may be used throughout this description. These terms are used with reference to embodiments of the technology and the orientations and relative positionings of the components thereof shown in the accompanying figures. Embodiments of the technology may be oriented in ways other than those shown in the figures. Therefore, the terms do not limit the scope of the present technology.

Embodiments of the present technology relate to an electronic device that can be worn on a user's wrist and that communicate wirelessly with other devices, systems, and networks. The electronic device may be a fitness watch, a wrist-worn smart phone, a wrist-worn navigation device, or other wearable multi-function electronic devices that include a housing and a wrist band, strap, or other attachment mechanism. Although the electronic device is typically worn on a wrist, it may also be worn on other parts of the body such as the forearm or the upper arm. The electronic device may be used to monitor the user's current location, distance traveled, velocity, and other performance metrics by receiving location signals from a satellite-based positioning system such as the global navigation satellite system (GNSS). The electronic device may be electronically paired with other devices such as a heart rate monitor worn around the user's chest, a foot pod attached to the user's shoe for measuring jogging or running cadence and distance, a bike speed and cadence sensor attached to a crank arm and wheel hub of the user's bicycle for tracking biking performance, and so forth. Furthermore, the electronic device may be able transmit and receive communication signals to communicate with smartphones, tablets, laptop or desktop computers, Wi-Fi routers, cell towers, and the like to allow the user to upload activity data, download apps, download or stream music, receive text messages, emails, and weather alerts, and so on. Thus, the electronic device may utilize or process signals with GNSS protocols, Bluetooth™, Wi-Fi, or telecommunication cellular protocols, and so forth.

Typically, separate antennas are required to receive location signals and transmit or receive communication signals. Thus, two or more antennas are proximately positioned within the housing or on a surface (e.g., the bezel) of the device and may simultaneously transmit and receive wireless signals. Although conventional electronic devices having large housings enable positioning of the two or more antennas away from each other as well as the electronic circuitry, which processes the electronic signals and provides other functionality. However, for electronic devices having a small housing, such as a wrist-worn electronic device, the size of an internal cavity of the housing or amount of surface area within or on which two or more antennas may be positioned is limited. Often, a smaller housing is more desirable than a large housing. Therefore, it is a challenge to separate and reduce coupling between the antennas and the electronic circuitry while minimizing the size of the device housing. Furthermore, the performance of two or more antennas may be affected adversely when the antennas operate at similar frequencies and are positioned close together. Thus, it is an additional challenge to space the antennas apart from each other within the constraints of the housing and the bezel.

Embodiments of the present technology provide a wrist-worn electronic device with an improved antenna configuration comprising a housing, a bezel, and a plurality of antennas. The housing includes a side wall. The bezel is coupled to the housing and includes a channel formed within the lower surface of the bezel in which an upper surface of the side wall may be positioned. The plurality of antennas may provide reception of GNSS wireless signals and transmission and reception of two or more bands of telecommunication protocols. For instance, electronic devices used in North America may transmit and receive telecommunication signals using three bands while electronic devices used in Europe and other regions may transmit and receive telecommunication signals using four bands. The antennas are positioned within the channel of the bezel, which allows for increased spacing between the antennas and electronic signal processing circuitry positioned on a circuit board as well as providing for the separation of antenna elements operating at similar frequencies.

Figure 1A:
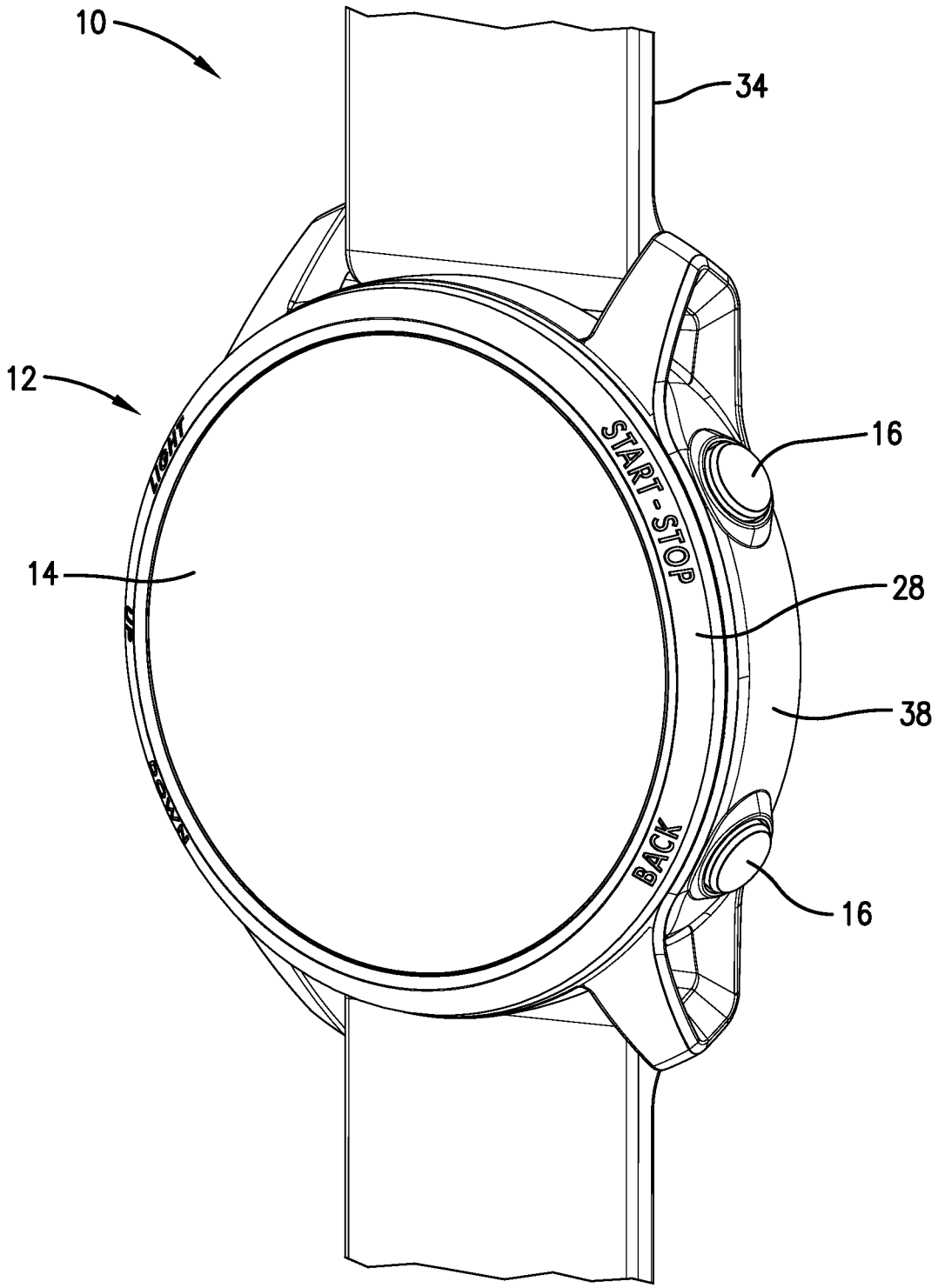
FIG. 1A is an upper perspective view of a wrist-worn electronic device, constructed in accordance with various embodiments of the present technology, featuring a housing with a display and a surrounding bezel which incorporates a location determining antenna and a communication antenna.
Figure 1B:
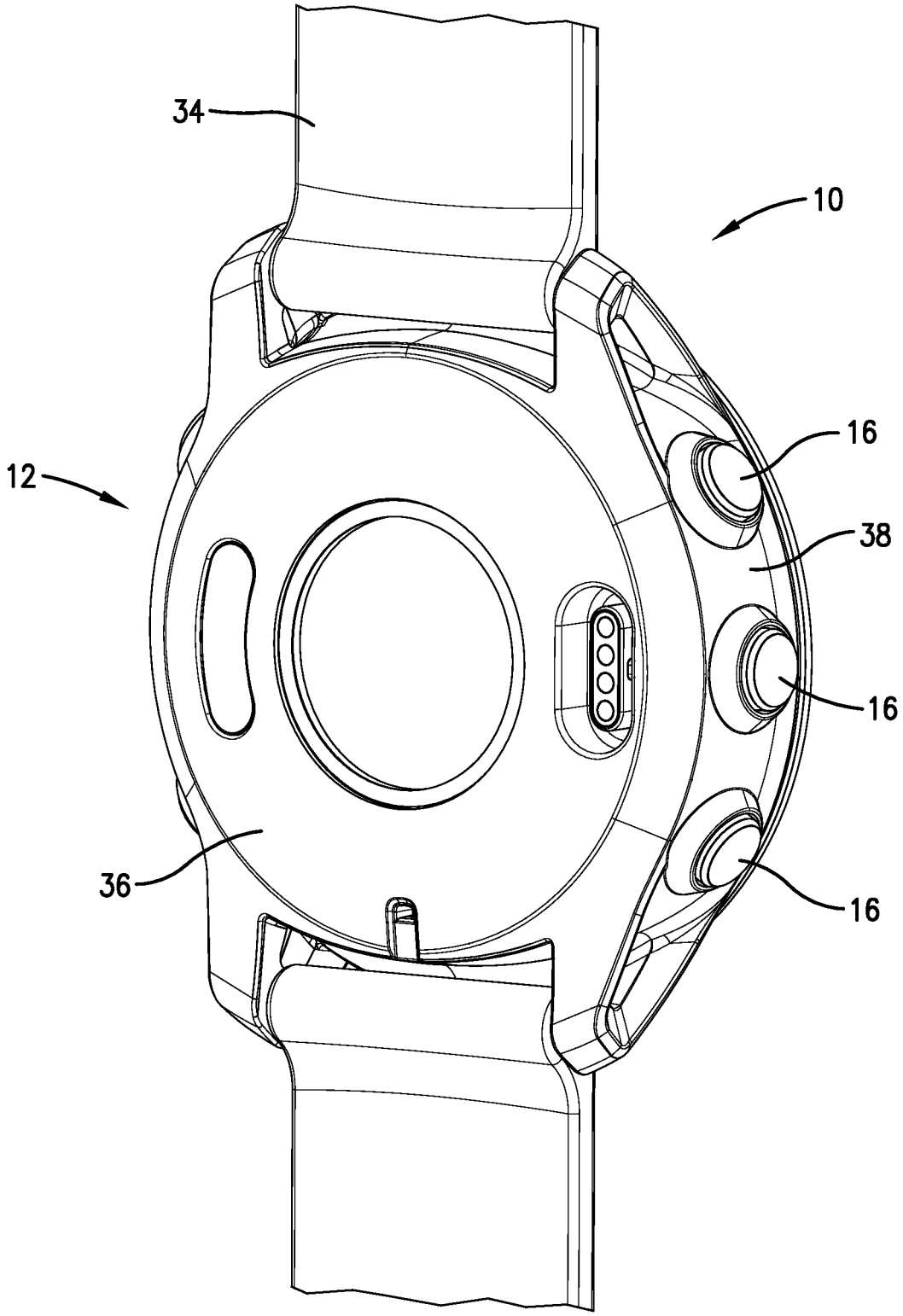
FIG. 1B is a lower perspective view of the electronic device.
Figure 2:
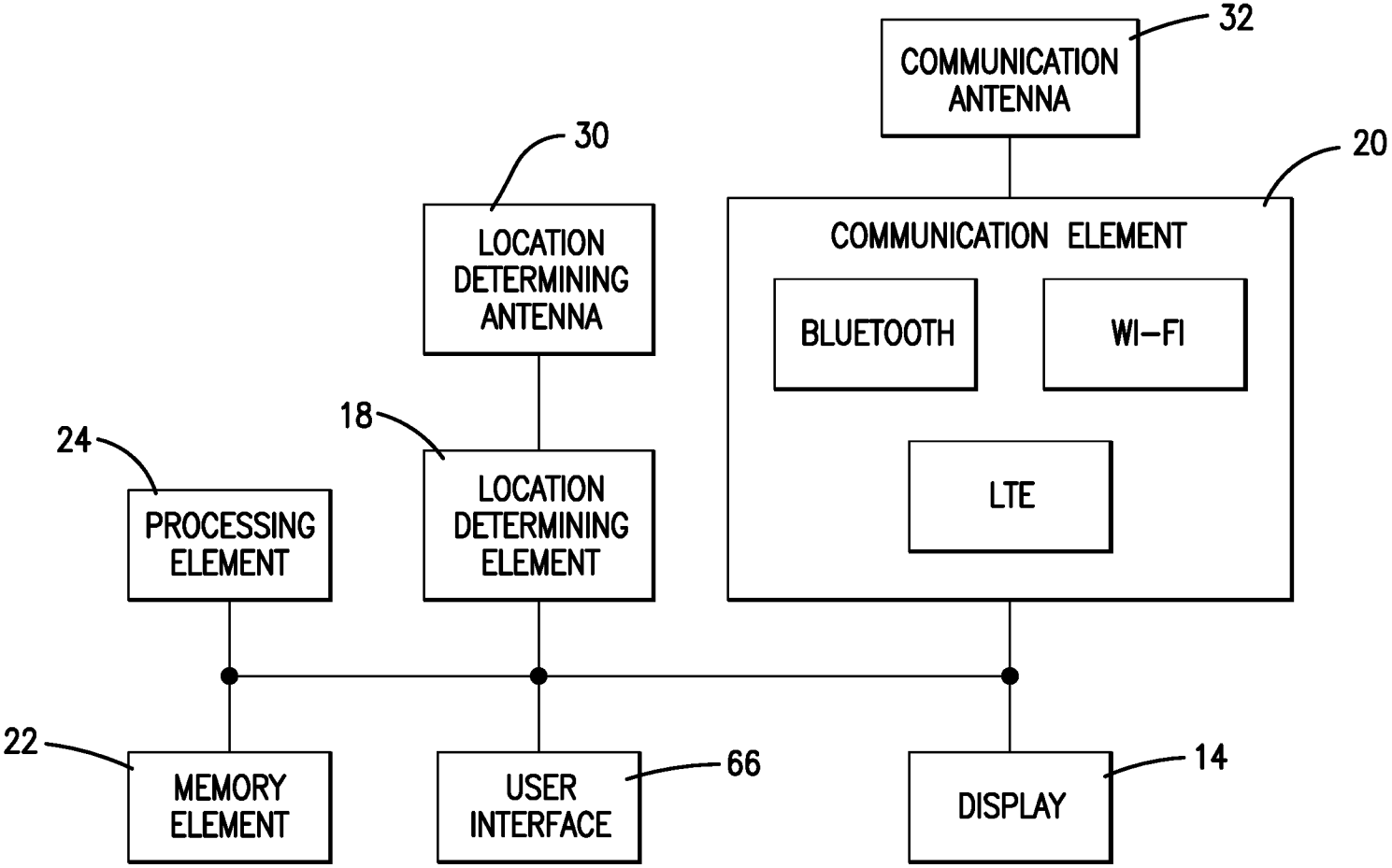
FIG. 2 is a schematic block diagram of various electronic components of the electronic device.

Embodiments of the technology will now be described in more detail with reference to the drawing figures. Referring initially to FIGS. 1A and 1B, an exemplary wrist-worn electronic device 10 is illustrated. The electronic device 10 broadly comprises a housing 12, a display 14, a plurality of pushbuttons 16, a bezel 28, and a wrist band 34, a strap, or other attachment mechanisms. As shown in FIG. 2, the electronic device 10 includes a location determining element 18, a communication element 20, a memory element 22, a processing element 24, a printed circuit board 26, a location determining antenna 30, and a communication antenna 32. The communication between the electronic components is illustrated schematically in FIG. 2.

The housing 12, shown in FIGS. 1A, 1B, and 3-6, generally houses or retains other components of the electronic device 10 and may include or be coupled to the wrist band 34. The housing 12 may include a bottom wall 36, at least one housing side wall 38, and an internal cavity 40. The bottom wall 36 includes a lower, outer surface that contacts the user's wrist while the user is wearing the electronic device 10. The housing side wall 38 couples to the bottom wall 36 at a lower edge of the housing side wall 38. In exemplary embodiments that are shown in the figures, the housing 12 includes a single housing side wall 38, with an inner surface, an opposing outer surface, and an upper surface. The housing side wall 38 may have a circular or ring shape which generally forms a hollow cylinder defining the internal cavity 40 in combination with the bottom wall 36 and display 14. It is to be understood the housing 12 may have any other shape, such as a square, rectangular, oval or elliptical shape. In still other embodiments, depending on the shape of the display 14, the housing 12 may include a plurality of housing side walls 38 which form one of a plurality of geometric or polygonal shapes, such as triangular, square or rectangular, hexagonal, octagonal, and so forth.

In exemplary embodiments, the housing side wall 38 further includes one or more through holes extending from the inner surface to the outer surface. Each pushbutton 16 or a portion thereof may be positioned in the through holes of the housing side wall 38. The bottom wall 36 defines an additional portion of the internal cavity 40. The bottom wall 36, housing side wall 38, bezel 28 and other components of the housing 12 may be formed from a combination of metal, metallic or non-metallic materials, such as plastic, rubber, glass, nylon, foam, polymers, silicone, vinyl.

The display 14, shown in FIG. 1A, generally presents at least a portion of the user interface 66, which may include information and graphics presented to a user. The information and graphics may include time of day, current location, and the like. The display 14 may be implemented in one of the following technologies: light-emitting diode (LED), organic LED (OLED), Light Emitting Polymer (LEP) or Polymer LED (PLED), liquid crystal display (LCD), thin film transistor (TFT) LCD, LED side-lit or back-lit LCD, or the like, or combinations thereof. In exemplary embodiments that are shown in the figures, the display 14 has a round or circular shape. In general, the display 14 may possess a shape that corresponds to the shape formed by the inner surface of bezel 28 or housing side wall 38 and the display 14 may have outer edges or a perimeter conforms and may couple to an inner surface of the bezel 28 or the housing side wall 38.

The user interface 66 generally allows the user to directly interact with the electronic device 10 and may include pushbuttons 16, rotating knobs, or the like. In exemplary embodiments of FIGS. 1, 2, and 4, the housing 12 may include one or more pushbuttons 16 located in the through holes of the housing side wall 38 that function as at least a portion of the user interface 66. In various embodiments, the display 14 may also include a touch screen occupying the entire display 14, or a portion thereof, so that the display 14 functions as at least a portion of the user interface 66. The touch screen may allow the user to interact with the electronic device 10 by physically touching, swiping, or gesturing on areas of the display 14.

The location determining element 18 generally determines a current geolocation of the electronic device 10 and may receive and process radio frequency (RF) signals from a multi-constellation global navigation satellite system (GNSS) such as the global positioning system (GPS), the GLONASS system, the Galileo system, or the like. The location determining element 18 may include satellite navigation receivers, processors, controllers, other computing devices, or combinations thereof, and memory. The location determining element 18 may process a location electronic signal received or communicated from the location determining antenna 30, which receives one or more location wireless signals from one or more satellites of the GNSS. The location wireless signal includes data from which geographic information, such as the current geolocation of the electronic device 10, is determined by the location determining element 18. The current geolocation may include coordinates, such as the latitude and longitude, of the current location of the electronic device 10. The location determining element 18 may communicate the current geolocation to the processing element 24, the memory element 22, or both.

Although embodiments of the location determining element 18 may include a satellite navigation receiver, it will be appreciated that other location-determining technology may be used. For example, cellular towers or any customized transmitting radio frequency towers can be used instead of satellites may be used to determine the location of the electronic device 10 by receiving data from at least three transmitting locations and then performing basic triangulation calculations to determine the relative position of the device with respect to the transmitting locations. With such a configuration, any standard geometric triangulation algorithm can be used to determine the location of the electronic device. The location determining element 18 may also include or be coupled with a pedometer, accelerometer, compass, or other dead-reckoning components which allow it to determine the location of the device 10. The location determining element 18 may determine the current geographic location through a communications network, such as by using Assisted GPS (A-GPS), or from another electronic device. The location determining element 18 may even receive location data directly from a user.

The communication element 20 generally enables and allows the electronic device 10 to communicate with other electronic devices, external systems, networks, and the like. The communication element 20 each may include signal and/or data transmitting and receiving circuits, such as amplifiers, filters, mixers, oscillators, digital signal processors (DSPs), and the like that process radio frequency (RF) electronic signals that include data transmitted and received using various communication standards. The communication element 20 processes a communication electronic signal by decoding data that has been received and encoding data to be transmitted. The communication electronic signal is communicated, or electronically coupled, between the communication element 20 and the communication antenna 32.

The communication element 20 may utilize telecommunication standards such as cellular 2G, 3G, or 4G, LTE, 5G, Institute of Electrical and Electronics Engineers (IEEE) 802.11 standard such as WiFi, IEEE 802.16 standard such as WiMAX, Bluetooth™, or combinations thereof. In addition, the communication element 20 may utilize communication standards such as ANT, ANT+, Bluetooth™ low energy (BLE), the industrial, scientific, and medical (ISM) band at 2.4 gigahertz (GHz), or the like. The communication element 20 may be in electronic communication with the processing element 24 and the memory element 22.

In various embodiments, the electronic device 10 may be configured to establish communication using a plurality of communication protocols or standards with exercise-related sensors, such as a foot pod, a bike speed and cadence sensor, or the like, with other electronic devices, such as a smartphone, a tablet, a laptop, or a desktop computer, or with service providers through routers, switches, hubs, access points, cell towers, and so forth. The communication element 20 may include a transceiver capable of using each protocol or standard, such as Bluetooth™, Wi-Fi, cellular (including 4G, LTE, 5G, etc.), or the like, enabling the device 10 to communicate with a variety of exercise-related sensors, other electronic devices and service providers.

The memory element 22 may be embodied by devices or components that store data in general, and digital or binary data in particular, and may include exemplary electronic hardware data storage devices or components such as read-only memory (ROM), programmable ROM, erasable programmable ROM, random-access memory (RAM) such as static RAM (SRAM) or dynamic RAM (DRAM), cache memory, hard disks, floppy disks, optical disks, flash memory, thumb drives, universal serial bus (USB) drives, solid state memory, or the like, or combinations thereof. In some embodiments, the memory element 22 may be embedded in, or packaged in the same package as, the processing element 24. The memory element 22 may include, or may constitute, a non-transitory "computer-readable medium". The memory element 22 may store the instructions, code, code statements, code segments, software, firmware, programs, applications, apps, services, daemons, or the like that are executed by the processing element 24. The memory element 22 may also store data that is received by the processing element 24 or the device in which the processing element 24 is implemented. The processing element 24 may further store data or intermediate results generated during processing, calculations, and/or computations as well as data or final results after processing, calculations, and/or computations. In addition, the memory element 22 may store settings, text data, documents from word processing software, spreadsheet software and other software applications, sampled audio sound files, photograph or other image data, movie data, databases, and the like.

The processing element 24 may comprise one or more processors. The processing element 24 may include electronic hardware components such as microprocessors (single-core or multi-core), microcontrollers, digital signal processors (DSPs), field-programmable gate arrays (FPGAs), analog and/or digital application-specific integrated circuits (ASICs), or the like, or combinations thereof. The processing element 24 may generally execute, process, or run instructions, code, code segments, code statements, software, firmware, programs, applications, apps, processes, services, daemons, or the like. The processing element 24 may also include hardware components such as registers, finite-state machines, sequential and combinational logic, configurable logic blocks, and other electronic circuits that can perform the functions necessary for the operation of the current invention. In certain embodiments, the processing element 24 may include multiple computational components and functional blocks that are packaged separately but function as a single unit. In some embodiments, the processing element 24 may further include multiprocessor architectures, parallel processor architectures, processor clusters, and the like, which provide high performance computing. The processing element 24 may be in electronic communication with the other electronic components of the electronic device 10 through serial or parallel links that include universal busses, address busses, data busses, control lines, and the like.

Figure 3:
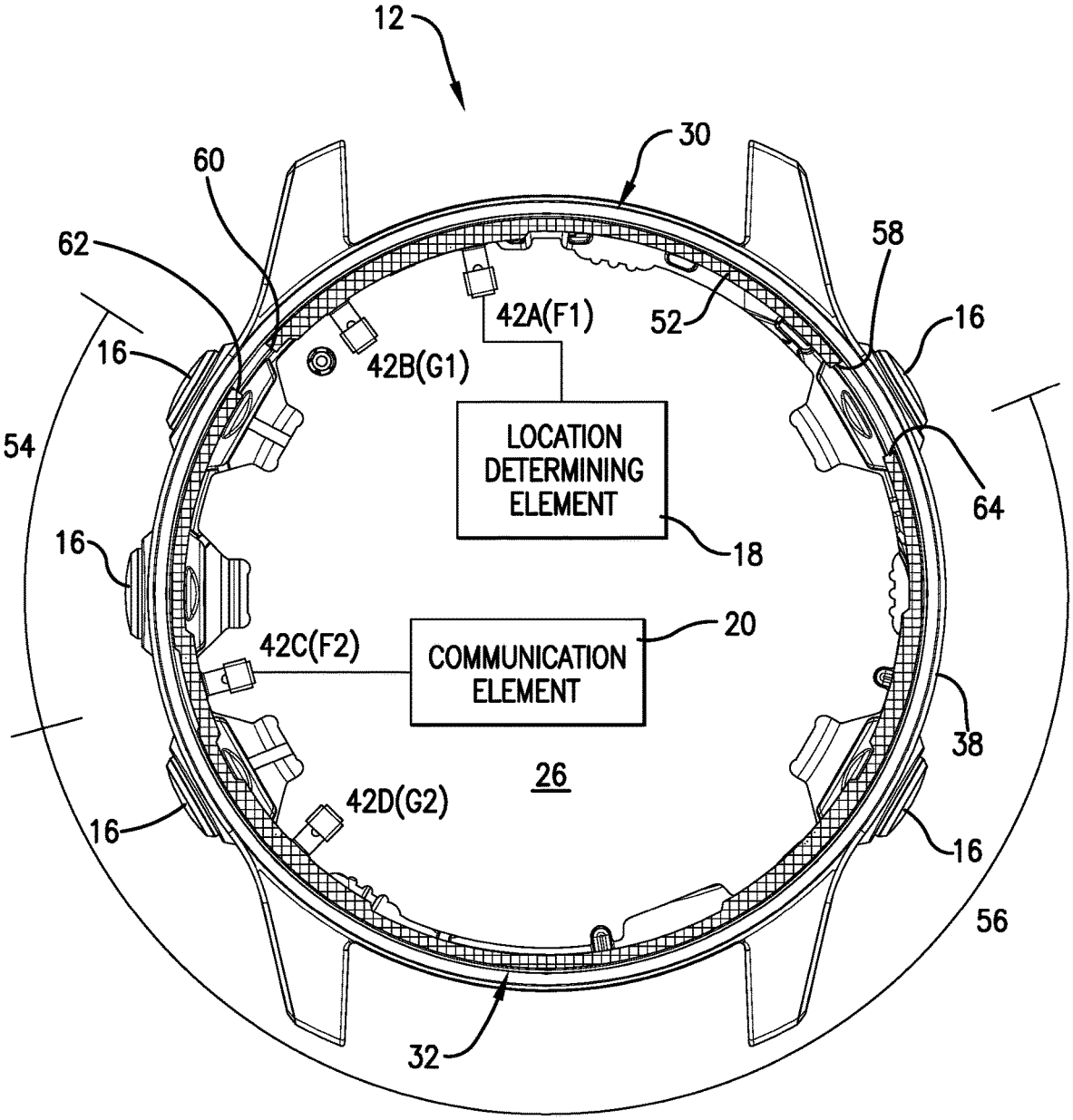
FIG. 3 is a top view of the electronic device with the display and the bezel removed to reveal the two antennas.
Figure 4:
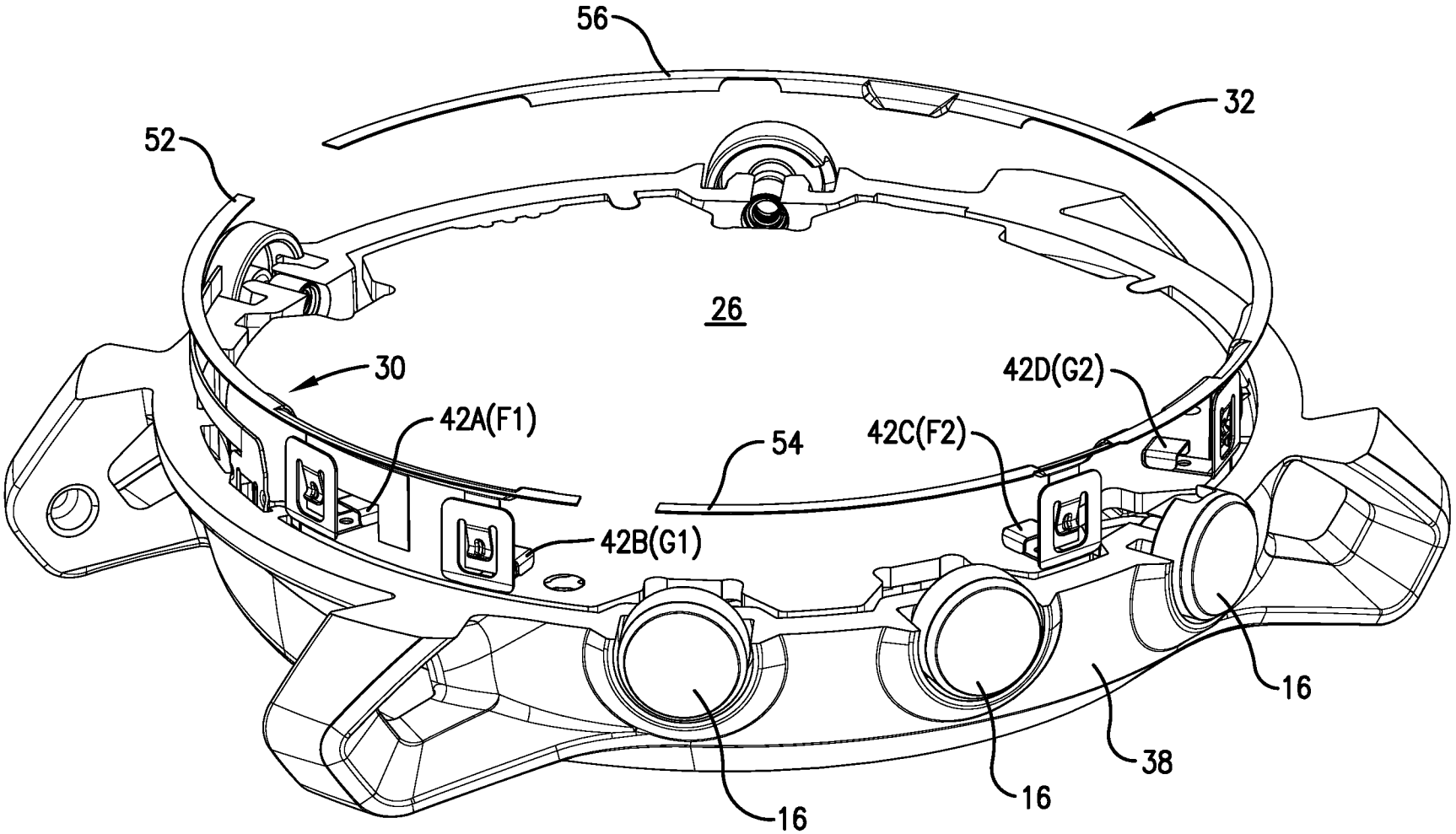
FIG. 4 is an upper perspective view of the electronic device with the display, the bezel, and a portion of the housing removed to reveal the location determining antenna and the communication antenna.

The printed circuit board 26, as shown in FIGS. 3 and 4, generally provides a substrate for supplying electric power to, and electronic communication between, the electronic components, such as the location determining element 18, the communication element 20, the memory element 22, and the processing element 24. The printed circuit board 26 may be constructed with a first and an opposing second side, such as a top side and a bottom side, respectively. The printed circuit board 26 may also include multiple electrically conductive layers with a top conductive layer placed on the first side, a bottom conductive layer placed on the second side, one or more inner conductive layers positioned between the first and second sides, and an insulating layer between each pair of adjacent conductive layers. The insulating layers may be formed from rigidized material that includes various combinations of fiberglass, woven glass, matte glass, cotton paper, phenolic cotton paper, polyester, epoxies, epoxy resins, and the like. Each conductive layer may include one or more conductive electronic signal or electrical power or ground traces, one or more signal, power, or ground pads, full or partial power planes, or full or partial ground planes. The conductive layers may be formed from metals typically including copper, but also including nickel, aluminum, gold, silver, palladium, zinc, tin, lead, and the like. In addition, the printed circuit board 26 may include plated through hole vias, blind vias, buried vias, and the like. The electronic components may be implemented in packages which are mounted, or retained, on the top side, the bottom side, or both sides. The electronic components may communicate with one another through electronic signal traces.

The electronic device 10 may further include a plurality of electrically conductive connectors 42 which provide a direct or an indirect electrical connection between electronic signals traces or power or ground planes on the printed circuit board 26 and elements of the location determining antenna 30 and the communication antenna 32. For example, a first connector 42A may electrically couple an electronic signal trace connected to the location determining element 18 with a point on the location determining antenna 30 associated with a signal feed point (F1). A second connector 42B may electrically couple an electronic ground plane or a trace connected to an electrical ground with a point on the location determining antenna 30 associated with an electrical ground point (G1). A third connector 42C may electrically couple an electronic signal trace connected to the communication element 20 with a point on the communication antenna 32 associated with a signal feed point (F2). A fourth connector 42D may electrically couple an electronic ground plane or trace connected to an electrical ground with a point on the communication antenna 32 associated with an electrical ground point (G2). Each connector 42A-42D may be formed from electrically conductive materials such as metals and/or metal alloys. Exemplary embodiments of each connector 42A-42D may include a first arm generally horizontally oriented that electrically couples with and connects to the printed circuit board 26 and a second arm generally vertically oriented that electrically couples with and connects to the antennas 30, 32.

The bezel 28, as seen in at least FIGS. 1A and 6, may be positioned along an upper edge of the housing side wall 38 and may generally partially cover the perimeter edges of display 14 and surround encircle the display 14. Exemplary embodiments of the bezel 28 have a circular or oval shape corresponding to the shapes of the housing side walls 38 and the display 14. Other shapes of the bezel 28 are possible depending on the shapes of the housing side wall 38 and the display 14. The bezel 28 is typically formed from an electrically nonconductive or insulating material. For instance, bezel 28 may be formed from thermoplastic materials doped with a (non-conductive) metallic inorganic compound, polymers, or the like.

Referring to FIG. 6, exemplary embodiments of the bezel 28 have an annular shape include a ring 44, a flange 46, and a bezel side wall 48. The ring 44 forms a portion of a face of the electronic device 10 and includes one or more upper edges that are planar with a first surface that slopes downward therefrom to the outer perimeter of the annular bezel 28 and a second surface that slopes downward therefrom to an inner perimeter of the annular bezel 28. The ring 44 surrounds the display 14 and may include an inward protruding shelf that may support and retain an outer portion of the display 14. The flange 46 is curved downward from an outer perimeter and edge of the ring 44. The bezel side wall 48 extends downward from a lower edge of the ring 44 and is spaced apart from the flange 46 and upper housing side wall 38 such that a channel 50 is defined in the space between the flange 46 and the bezel side wall 48. The bezel 28 partially forms and couples to the housing 12 with the flange 46 in contact with the housing side wall 38.

Each of the location determining antenna 30 and the communication antenna 32, shown in crosshatch in FIG. 3, converts wireless RF electromagnetic radiation (a wireless signal) at a particular frequency, i.e., a resonant frequency, into a corresponding electronic signal and converts an electronic signal into a corresponding wireless signal. Each of the antennas 30, 32 may be implemented as various types of antenna, such as a loop antenna, a microstrip antenna, a patch antenna, a slot antenna, a linear antenna, an inverted F-antenna, a monopole antenna, a dipole antenna, or the like. In addition, each of the antennas 30, 32 may include a component or element that has an active length which is proportional to, corresponds to, or varies according to, a wavelength, or a portion thereof, such as a half wavelength or a quarter wavelength, of the wireless signal desired to be transmitted and/or received using antennas 30, 32.

The location determining antenna 30 is utilized to receive GNSS wireless signals in general and GPS wireless signals in particular. Exemplary embodiments of the location determining antenna 30 are implemented as an inverted-F antenna configured to receive the GPS L1 band signal, which has a center frequency of approximately 1575 MHz. Referring to FIGS. 3-6, the location determining antenna 30 includes an arm 52 that has a horizontal planar portion that is parallel with display 14, a vertical portion that is parallel with the bezel side wall 48 (and housing side wall 38) and a curved portion therebetween. In embodiments, the arm 52 has a curvature along its axial length that allows the location determining antenna 30 to be positioned within the channel 50 extending along the circumference of the bezel 28. The horizontal planar portion of the arm 52 is located (positioned) on a lower surface of bezel 28 opposing (beneath) the ring 44 in parallel with the plane of the display 14, and the curved portion is located (positioned) along an outer surface of the bezel side wall 48. At least the horizontal planar portion of the arm 52 may be positioned above the housing side wall 38. The location determining antenna 30 may be positioned to occupy a first portion of the circumference of the bezel 28 from approximately 11 o'clock extending clockwise to approximately 2 o'clock. The location determining antenna 30 includes a feed point (F1) for the location electronic signal and an electronic ground point (G1) spaced apart from the feed point (F1) of the arm 52. The feed point (F1) of the location determining antenna 30 is electrically connected to the printed circuit board 26 through the first connector 42A. The ground point (G1) of the location determining antenna 30 is electrically connected to the printed circuit board 26 through the second connector 42B.

Placement of the location determining antenna 30 near the top of the housing 12 (proximate to a 12 o'clock position) and positioning a point on the location determining antenna 30 associated with a signal feed (F1) such that it is offset in a counterclockwise direction from a midpoint of the location determining antenna 30 may improve performance of receiving location wireless signals by improving the right-hand circular polarization (RHCP) towards the sky and left-hand circular polarization (LHCP) towards the ground. In addition, such features may result in the location determining antenna 30 having a first grounded end 60 and a first open end 58 on opposing sides of arm 52.

The communication antenna 32 is utilized to receive communication or telecommunication wireless signals, such as Bluetooth™, Wi-Fi, cellular (e.g., 3G, 4G, LTE, 5G, etc.), or the like. Exemplary embodiments of the communication antenna 32 are implemented as a T-shaped monopole antenna configured to transmit and receive LTE wireless signals. In some embodiments, the communication antenna 32 may have a single arm, similar to arm 52 of the location determining antenna 30, that wirelessly transmit or receive a plurality of communications signals. In other embodiments, the communication antenna 32 may have a plurality of arms, which have an expanded range of frequencies, that wirelessly transmit or receive a plurality of communications signals. For instance, as shown in FIGS. 3 and 4, the communication antenna 32 may have a first arm 54, which is of a length enabling communication element 20 to transmit and receive mid band LTE wireless signals (such as signals having frequencies ranging from approximately 1700 MHz to approximately 2200 MHz), and a second arm 56, which is of a length enabling communication element 20 to transmit and receive low band LTE wireless signals (such as bands 12, 28, 8 or others, which may have a center frequency between approximately 700 MHz and approximately 960 MHz, including 829 MHz).

Similar to the location determining antenna 30, positioning a point on the communication antenna 32 associated with a signal feed point (F2) such that it is offset from a midpoint of the communication antenna 32 in a clockwise direction (as shown in FIG. 3) or a counterclockwise direction may result in the communication antenna 32 having a second open end 62 and a third open end 64 on opposing sides of communication antenna 32 corresponding with arms 54 and 56, respectively. The signal feed point (F2) of the communication antenna 32 separates the first arm 54 from the second arm 56.

Similar to arm 52 of the location determining antenna 30, each of the first arm 54 and the second arm 56 includes a horizontal planar portion that is parallel with display 14, a vertical portion that is parallel with the bezel side wall 48 (and housing side wall 38) and a curved portion therebetween. In addition, each arm 54, 56 has a curvature along its axial length which allows the communication antenna 32 to be positioned within the channel 50 extending along the circumference of the bezel 28. The horizontal planar portion of each arm 54, 56 is located (positioned) on a lower surface of bezel 28 opposing (beneath) the ring 44 in parallel with the plane of the display 14, and the curved portion is located (positioned) along an outer surface of the bezel side wall 48. At least the horizontal planar portion of each arm 54, 56 may be positioned above the housing side wall 38.

The first arm 54 of the communication antenna 32 is positioned to occupy a second portion of the circumference of the bezel 28 from approximately 8 o'clock, which is the location of the signal feed point (F2), extending clockwise to approximately 10 o'clock. The second arm 56 of the communication antenna 32 is positioned to occupy a third portion of the circumference of the bezel 28 from approximately 8 o'clock extending counterclockwise to approximately 2 o'clock. The signal feed point F2 for the communication antenna 32 is positioned at approximately 8 o'clock, roughly at junction of the first end of the first arm 54 and the first end of the second arm 56. Spaced apart from the signal feed point (F2), in a counterclockwise direction, is an electrical ground point (G2). The signal feed point (F2) is electrically connected to the printed circuit board 26 through the third connector 42C. In embodiments where the communication antenna 32 is implemented as an inverted-F antenna, the electrical ground point (G2) is electrically connected to the printed circuit board 26 through the fourth connector 42D. In other embodiments, such as where the communication antenna 32 is implemented as a T-shaped monopole antenna, the electrical ground point (G2) may not be electrically connected to the printed circuit board 26 through the fourth connector 42D.

In embodiments, arm 52 of the location determining antenna 30 receives wireless signals that have a frequency of approximately 1575 MHz (in the GPS L1 band), and the first arm 54 of the communication antenna 32 transmits and receives wireless signals that have a frequency of approximately 1700 MHz (and higher). The difference between these two operating frequencies is 125 MHz, which is relatively small as a percentage difference, and coupling may occur between arm 52 of the location determining antenna 30 and first arm 54 of the communication antenna 32. In general, as the difference between the operating frequencies of two antennas is reduced, the possibility or potential for undesirable or adverse effects, such as coupling, crosstalk, noise induction, or combinations thereof, between the signals of the two antennas increases.

With the two antennas 30, 32 of the current technology, these adverse effects may reduce performance and be problematic when the location determining antenna 30 is receiving signals and the first arm 54 of the communication antenna 32 is transmitting signals simultaneously and the adverse effect may vary according to an inverse of a physical distance that separates the open ends of the two antennas 30, 32. For example, for the arm 52 of the location determining antenna 30 and first arm 54 of the communication antenna 32 that are transmitting or receiving signals that are separated by approximately 150 MHz, the adverse effect typically increases as the distance between the first open end 58 of the location determining antenna 30 and the second open end 62 of the first arm 54 of the communication antenna 32 decreases and the adverse effect typically decreases as the distance between the first open end 58 of the location determining antenna 30 and the second open end 62 of the first arm 54 of the communication antenna 32 increases. The adverse effects between the arm 52 of the location determining antenna 30 and first arm 54 of the communication antenna 32 may be significantly greater than adverse effects caused by second arm 56 on either arm 52 or first arm 54. This may be due in part to second arm 56 having a length enabling communication element 20 to transmit and receive low band LTE wireless signals (using frequencies ranging from approximately 700 MHz to 960 MHz) as opposed to the mid band LTE wireless signals transmitted and received by first arm 54 (using frequencies ranging from approximately 1700 MHz to 2200 MHz) and the GPS L1 band signals received by arm 52 (at frequencies including 1575 MHz), which are spectrally separated by approximately 125 MHz. It is to be understood that, in some embodiments, communication antenna 32 may consist of a single arm (similar to the first arm 54) that is utilized to receive signals having a frequency of approximately 1700 MHz.

Performance of antennas 30, 32 may be improved by positioning the first open end 58 of location determining antenna 30, the second open end 62 of communication antenna 32 and the third open end 64 of communication antenna 32 around the perimeter of bezel 28 as shown in FIG. 3. In order to increase separation and reduce adverse effects between the two antennas 30, 32 within the size and shape constraints of the housing 12 and the bezel 28, the two antennas 30, 32 may be positioned such that the first open end 58 of arm 52 of the location determining antenna 30 is located at approximately 2 o'clock and the second open end 62 of the first arm 54 of the communication antenna 32 is located at approximately 10 o'clock. The separated positioning may have an angular value of approximately 120 degrees, but it is to be understood that the angular separation between the open ends 58, 62 of arm 52 and first arm 54, respectively, may have a range from approximately 90 degrees to approximately 150 degrees (in a counterclockwise direction).

In embodiments including the second arm 56 of communication antenna 32, the first open end 58 of the arm 52 of the location determining antenna 30 may be positioned such that an angular separation ranging from approximately 15 to approximately 90 degrees exists (in a clockwise direction or a counterclockwise direction) between the first open end 58 and the third open end 64 of the second arm 56 of the communication antenna 32. As shown in FIG. 3, the first open end 58 of arm 52 of the location determining antenna 30 may be separated from the third open end 64 of the second arm 56 of the communication antenna 32 by approximate 15 degrees.

This separated positioning of the open ends 58, 62 of arm 52 and first arm 54, respectively results in increased signal isolation, which improves the performance of each antenna 30, 32, and reduces coupling between the antennas 30, 32 while they are utilizing signals separated by 125 MHz. For example, performance of the first arm 54 when used with communication element 20 as positioned in the first embodiment, in which the second open end 62 of the first arm 54 is positioned away from the first open end 58 of the arm 52 when used with location determining element 18, may be improved by at least 10 dB in comparison to a communication antenna 32 utilized to transmit or receive mid band LTE wireless signals (having frequencies including approximately 1700 MHz) having an open end proximate to the first open end 58 of location determining antenna 30 utilized to receive GPS L1 band signals (at frequencies including approximately 1575 MHz).

Each of the location determining antenna 30 and the communication antenna 32 may be formed from electrically conductive materials such as metals and/or metal alloys. In some embodiments, each antenna 30, 32 may be formed separately and placed in the channel 50 extending along a lower surface of the circumference of the bezel 28 and defined by bezel side wall 48 spaced apart from the flange 46 of bezel 28 or the upper portion of housing side wall 38, as described above. In other embodiments, the bezel 28 is formed from thermoplastic materials doped with a (non-conductive) metallic inorganic compound, polymers, or the like. Each antenna 30, 32 is created in, or on, the channel 50 by laser selective plating, laser direct structuring, laser-induced selective activation, or the like which activates the metallic inorganic compound of the bezel 28 material. In still other embodiments, each antenna 30, 32 is printed or deposited in, or on, the channel 50.

Although the technology has been described with reference to the embodiments illustrated in the attached drawing figures, it is noted that equivalents may be employed and substitutions made herein without departing from the scope of the technology as recited in the claims.

Having thus described various embodiments of the technology, what is claimed as new and desired to be protected by Letters Patent includes the following:

1. A wrist-worn electronic device comprising:

a housing including an internal cavity, a bottom wall configured to contact a wearer's wrist, and a side wall defining a portion of the internal cavity and including an upper surface;

a display aligned with the internal cavity configured to display information;

a bezel surrounding the display and coupled to the housing, the bezel including a lower surface incorporating a channel positioned around the upper surface of the side wall;

a location determining antenna configured to receive global navigation satellite system wireless signals, the location determining antenna being an inverted-F antenna positioned to align with a first portion of the bezel and positioned within the channel of the bezel above the upper surface of the side wall and including a planar portion oriented in parallel with a plane of the bezel; and a communication antenna implemented as a T-shaped monopole antenna configured to transmit and receive telecommunication protocol wireless signals, the communication antenna including a planar portion oriented in parallel with a plane of the bezel and positioned within the channel of the bezel above the upper surface of the side wall to align with a second portion of the bezel spaced apart from the first portion of the bezel.

2. The wrist-worn electronic device of claim 1, wherein the location determining antenna is in contact with the lower surface of the bezel and the upper surface of the side wall.

3. The wrist-worn electronic device of claim 1, wherein the bezel is formed from electrically nonconducting material.

4. The wrist-worn electronic device of claim 1, wherein the communication antenna includes a first arm configured to transmit and receive mid band long term evolution (LTE) wireless signals having frequencies ranging from approximately 1700 MHz to approximately 2200 MHz and a second arm configured to low band LTE wireless signals having a center frequency of approximately 829 MHz.

5. The wrist-worn electronic device of claim 4, wherein the location determining antenna has an arm including an open end, the first arm of the communication antenna includes an open end, and the open end of the location determining antenna is positioned to have an angular separation from the open end of the first arm of the communication antenna with a value ranging from approximately 100 degrees to approximately 140 degrees.

6. The wrist-worn electronic device of claim 1, wherein the communication antenna includes a feed point near a junction of the first arm and the second arm.

7. A wrist-worn electronic device comprising:

a housing including an internal cavity, a bottom wall configured to contact a wearer's wrist, and a side wall defining a portion of the internal cavity and including an upper surface;

a display aligned with the internal cavity configured to display information;

a bezel surrounding the display and coupled to the housing, the bezel including a lower surface incorporating a channel positioned around the upper surface of the side wall;

a location determining antenna configured to receive global navigation satellite system wireless signals, the location determining antenna positioned within the channel of the bezel above the upper surface of the side wall and including a planar portion oriented in parallel with a plane of the bezel; and a communication antenna configured to transmit and receive communication protocol wireless signals, the communication antenna positioned within the channel of the bezel above the upper surface of the side wall and including a planar portion oriented in parallel with a plane of the bezel.

8. The wrist-worn electronic device of claim 7, wherein the location determining antenna is in contact with the lower surface of the bezel and the upper surface of the side wall.

9. The wrist-worn electronic device of claim 7, wherein the bezel is formed from electrically nonconducting material.

10. The wrist-worn electronic device of claim 7, wherein the location determining antenna is an inverted-F antenna that is positioned to align with a first portion of the bezel, and the communication antenna is a T-shaped monopole antenna that is positioned to align with a second portion of the bezel spaced apart from the first portion of the bezel.

11. The wrist-worn electronic device of claim 10, wherein the communication antenna includes a first arm configured to transmit and receive mid band long term evolution (LTE) wireless signals having frequencies ranging from approximately 1700 MHz to approximately 2200 MHz and a second arm configured to low band LTE wireless signals having a center frequency of approximately 829 MHz.

12. The wrist-worn electronic device of claim 11, wherein the location determining antenna has an arm including an open end, the first arm of the communication antenna includes an open end, and the open end of the arm of the location determining antenna is positioned to have an angular separation from the open end of the first arm of the communication antenna with a value ranging from approximately 100 degrees to approximately 140 degrees.

13. The wrist-worn electronic device of claim 12, wherein the communication antenna includes a feed point near a junction of the first arm and the second arm.

14. A wrist-worn electronic device comprising:

a housing including an internal cavity, a bottom wall configured to contact a wearer's wrist, and a side wall defining a portion of the internal cavity and including an upper surface;

a display aligned with the internal cavity configured to display information;

a bezel surrounding the display and coupled to the housing, the bezel including a lower surface incorporating a channel positioned around the upper surface of the side wall;

a location determining antenna configured to receive global navigation satellite system wireless signals, the location determining antenna positioned within the channel of the bezel above the upper surface of the side wall and including a planar portion oriented in parallel with a plane of the bezel, the location determining antenna implemented as an inverted-F antenna including an arm having an open end; and a communication antenna configured to transmit and receive communication protocol wireless signals, the communication antenna positioned within the channel of the bezel above the upper surface of the side wall and including a planar portion oriented in parallel with a plane of the bezel, the communication antenna implemented as an T-shaped monopole antenna including a first arm having an open end, wherein the open end of the arm of the location determining antenna is positioned to have an angular separation from the open end of the first arm of the communication antenna of at least 90 degrees in a counterclockwise direction.

15. The wrist-worn electronic device of claim 14, wherein the location determining antenna is in contact with the lower surface of the bezel and the upper surface of the side wall.

16. The wrist-worn electronic device of claim 14, wherein the bezel is formed from electrically nonconducting material.

17. The wrist-worn electronic device of claim 14, wherein the location determining antenna is positioned to align with a first portion of the bezel, and the communication antenna is positioned to align with a second portion of the bezel spaced apart from the first portion of the bezel.

18. The wrist-worn electronic device of claim 14, wherein the first arm of the communication antenna is configured to transmit and receive mid band long term evolution (LTE) wireless signals having frequencies ranging from approximately 1700 MHz to approximately 2200 MHz and the communication antenna includes a second arm configured to low band LTE wireless signals having a center frequency of approximately 829 MHz, wherein the open end of the arm of the location determining antenna is positioned to have an angular separation from the open end of the second arm of the communication antenna of at least 15 degrees in a clockwise direction.

* * * * *